US009377239B2

(12) United States Patent
Mock et al.

(10) Patent No.: US 9,377,239 B2
(45) Date of Patent: Jun. 28, 2016

(54) DUAL-REFLUXED HEAVIES REMOVAL COLUMN IN AN LNG FACILITY

(75) Inventors: Jon M. Mock, Katy, TX (US); Michael A. Wilkes, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 1616 days.

(21) Appl. No.: 11/940,749

(22) Filed: Nov. 15, 2007

(65) Prior Publication Data

US 2009/0126401 A1 May 21, 2009

(51) Int. Cl.

*F25J 3/02* (2006.01)
*F25J 1/02* (2006.01)
*F25J 1/00* (2006.01)

(52) U.S. Cl.

CPC ..... *F25J 3/0209* (2013.01); *F25J 1/004* (2013.01); *F25J 1/0022* (2013.01); *F25J 1/0052* (2013.01); *F25J 1/021* (2013.01); *F25J 1/0265* (2013.01); *F25J 3/0233* (2013.01); *F25J 3/0238* (2013.01); *F25J 3/0242* (2013.01); *F25J 2200/02* (2013.01); *F25J 2200/04* (2013.01); *F25J 2200/70* (2013.01); *F25J 2200/76* (2013.01); *F25J 2200/78* (2013.01); *F25J 2205/02* (2013.01); *F25J 2205/04* (2013.01); *F25J 2210/06* (2013.01); *F25J 2215/62* (2013.01); *F25J 2235/60* (2013.01); *F25J 2245/02* (2013.01); *F25J 2270/02* (2013.01); *F25J 2270/12* (2013.01); *F25J 2270/60* (2013.01); *F25J 2290/40* (2013.01)

(58) Field of Classification Search

CPC ..... F25J 2200/78; F25J 3/0209; F25J 3/0233; F25J 3/0238; F25J 3/0242

USPC ..... 62/611, 612, 618, 620, 623, 630

See application file for complete search history.

(56) References Cited

U.S. PATENT DOCUMENTS

| | | | | |
|---|---|---|---|---|
| 4,512,782 | A * | 4/1985 | Bauer | B01D 3/146 202/154 |
| 4,770,683 | A * | 9/1988 | Stothers | 62/625 |
| RE33,408 | E * | 10/1990 | Khan | C07C 7/09 62/621 |
| 5,325,673 | A | 7/1994 | Durr et al. | |
| 6,112,549 | A | 9/2000 | Yao et al. | |
| 6,116,050 | A | 9/2000 | Yao et al. | |
| 6,401,486 | B1 | 6/2002 | Lee et al. | |
| 6,516,631 | B1 * | 2/2003 | Trebble | 62/630 |
| 6,581,410 | B1 * | 6/2003 | Johnson et al. | 62/621 |
| 6,662,589 | B1 | 12/2003 | Roberts et al. | |
| 6,925,837 | B2 * | 8/2005 | Eaton | 62/612 |
| 2002/0166336 | A1 * | 11/2002 | Wilkinson | C07C 7/005 62/620 |
| 2004/0187520 | A1 | 9/2004 | Wilkinson et al. | |
| 2004/0206112 | A1 * | 10/2004 | Mak | 62/617 |
| 2004/0261452 | A1 * | 12/2004 | Mak et al. | 62/620 |

(Continued)

FOREIGN PATENT DOCUMENTS

| | | |
|---|---|---|
| EP | 0599443 | 6/1994 |
| EP | 1304535 | 4/2003 |

(Continued)

*Primary Examiner* — John F Pettitt

(74) *Attorney, Agent, or Firm* — ConocoPhillips Company

(57) ABSTRACT

A liquefied natural gas facility employing a heavies removal column having multiple reflux streams. The reflux streams can have different compositions and can be operable to reduce the critical pressure of the fluids within the heavies removal column in order to permit the column to operate at higher pressures without adversely affecting the horsepower requirements of plant compressor/driver systems.

11 Claims, 7 Drawing Sheets

(56) References Cited

U.S. PATENT DOCUMENTS

| | | | | |
|---|---|---|---|---|
| 2007/0012071 | A1* | 1/2007 | Huang et al. | 62/612 |
| 2007/0012072 | A1* | 1/2007 | Qualls et al. | 62/613 |
| 2007/0056318 | A1* | 3/2007 | Ransbarger F25J 1/0022 | 62/611 |
| 2007/0157663 | A1* | 7/2007 | Mak et al. | 62/620 |
| 2007/0240450 | A1* | 10/2007 | Mak | 62/626 |

FOREIGN PATENT DOCUMENTS

| | | |
|---|---|---|
| EP | 1340951 | 9/2003 |
| EP | 1340952 | 9/2003 |
| EP | 1455152 | 9/2004 |
| EP | 1469266 | 10/2004 |
| WO | WO 0188447 | 11/2001 |

* cited by examiner

DUAL-REFLUXED HEAVIES REMOVAL COLUMN IN AN LNG FACILITY

BACKGROUND OF THE INVENTION

1. Field of the Invention

This invention relates to methods and apparatuses for liquefying natural gas. In another aspect, the invention concerns a liquefied natural gas (LNG) facility employing a dual-refluxed heavies removal column.

2. Description of the Prior Art

Cryogenic liquefaction is commonly used to convert natural gas into a more convenient form for transportation and/or storage. Because liquefying natural gas greatly reduces its specific volume, large quantities of natural gas can be economically transported and/or stored in liquefied form.

Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers.

Storing natural gas in its liquefied form can help balance out periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Several methods exist for liquefying natural gas. Some methods produce a pressurized LNG (PLNG) product that is useful, but requires expensive pressure-containing vessels for storage and transportation. Other methods produce an LNG product having a pressure at or near atmospheric pressure. In general, these non-pressurized LNG production methods involve cooling a natural gas stream via indirect heat exchange with one or more refrigerants and then expanding the cooled natural gas stream to near atmospheric pressure. In addition, most LNG facilities employ one or more systems to remove contaminants (e.g., water, acid gases, nitrogen, and ethane and heavier components) from the natural gas stream at different points during the liquefaction process.

At some point during the liquefaction process, many LNG facilities employ one or more distillation columns operable to remove a majority of the butane and heavier components from the natural gas stream. Failure to remove these heavy components prior to the complete liquefaction of the natural gas will cause the higher molecular weight materials to freeze and plug downstream heat exchangers and other process equipment. In most cases, ensuring adequate heavy hydrocarbon removal from the natural gas stream is complicated by the need to maximize operating pressure of the distillation column or columns in order to minimize horsepower requirements for the facility's compressor/driver systems, which are typically the largest single energy consumers. As the operating pressure of the column or columns nears the critical pressure of methane (i.e., about 550 psia), the column's separation efficiency declines rapidly, resulting in increased carryover of butane and heavier material into downstream equipment. Alternatively, operating the column at a reduced pressure in order to avoid heavies carryover increases energy consumption and, ultimately, results in higher plant operating costs.

Thus, a need exists for an LNG facility capable of minimizing compressor/driver horsepower requirements while efficiently separating the heavy hydrocarbon material from the natural gas stream.

SUMMARY OF THE INVENTION

In one embodiment of the present invention, there is provided a method for liquefying a natural gas stream, the method comprising: (a) cooling a predominantly methane stream in a refrigeration cycle; (b) separating the cooled predominantly methane stream in a distillation column to thereby produce a bottoms stream and an overhead stream; (c) introducing a first reflux stream comprising at least about 85 mole percent methane into the distillation column; and (d) introducing a second reflux stream into the distillation column at a lower elevation than the first reflux stream, wherein the second reflux stream comprises at least a portion of the bottoms stream.

In another embodiment of the present invention, there is provided a method for liquefying a natural gas stream, the method comprising: (a) separating a predominantly methane stream having a temperature less than about −50° F. in a first distillation column to thereby produce a first overhead stream and a first bottoms stream; (b) separating at least a portion of the first bottoms stream in a second distillation column to thereby produce a first product stream; (c) introducing a first reflux stream comprising at least a portion of the first overhead stream into the first distillation column; and (d) introducing a second reflux stream comprising at least a portion of the first product stream into the first distillation column, wherein at least a portion of the second reflux stream is introduced into the first distillation column at a lower elevation than the first reflux stream.

In yet another embodiment of the present invention, there is provided an apparatus for liquefying natural gas in an LNG facility. The apparatus comprises a first distillation column, a second distillation column, and a heat exchanger. The first distillation column defines a fluid inlet, an upper outlet, a lower outlet, a first reflux inlet, and a second reflux inlet. The second reflux inlet is located at a lower elevation than the first reflux inlet. The heat exchanger defines a warming pass and a cooling pass. The warming pass defines a cool fluid inlet and a warm fluid outlet, and the cooling pass defines a warm fluid inlet and a cool fluid outlet. The cool fluid inlet of the warming pass is coupled in fluid flow communication with the lower outlet of the first distillation column, and the cool fluid outlet of the cooling pass is coupled in fluid flow communication with the second reflux inlet of the first distillation column. The second distillation column defines a fluid inlet and a product outlet. The fluid inlet of the second distillation column is coupled in fluid flow communication with the warm fluid outlet of the warming pass, and the product outlet of the second distillation column is coupled in fluid flow communication with the warm fluid inlet of the cooling pass.

BRIEF DESCRIPTION OF THE FIGURES

Certain embodiments of the present invention are described in detail below with reference to the enclosed figures, wherein.

DETAILED DESCRIPTION

The present invention can be implemented in a facility used to cool natural gas to its liquefaction temperature to thereby produce liquefied natural gas (LNG). The LNG facility generally employs one or more refrigerants to extract heat from the natural gas and then reject the heat to the environment. Numerous configurations of LNG systems exist, and the present invention may be implemented many different types of LNG systems.

In one embodiment, the present invention can be implemented in a mixed refrigerant LNG system. Examples of mixed refrigerant processes can include, but are not limited to, a single refrigeration system using a mixed refrigerant, a propane pre-cooled mixed refrigerant system, and a dual mixed refrigerant system.

In another embodiment, the present invention is implemented in a cascade LNG system employing a cascade-type refrigeration process using one or more pure component refrigerants. The refrigerants utilized in cascade-type refrigeration processes can have successively lower boiling points in order to maximize heat removal from the natural gas stream being liquefied. Additionally, cascade-type refrigeration processes can include some level of heat integration. For example, a cascade-type refrigeration process can cool one or more refrigerants having a higher volatility via indirect heat exchange with one or more refrigerants having a lower volatility. In addition to cooling the natural gas stream via indirect heat exchange with one or more refrigerants, cascade and mixed-refrigerant LNG systems can employ one or more expansion cooling stages to simultaneously cool the LNG while reducing its pressure to near atmospheric pressure.

Figure 1:
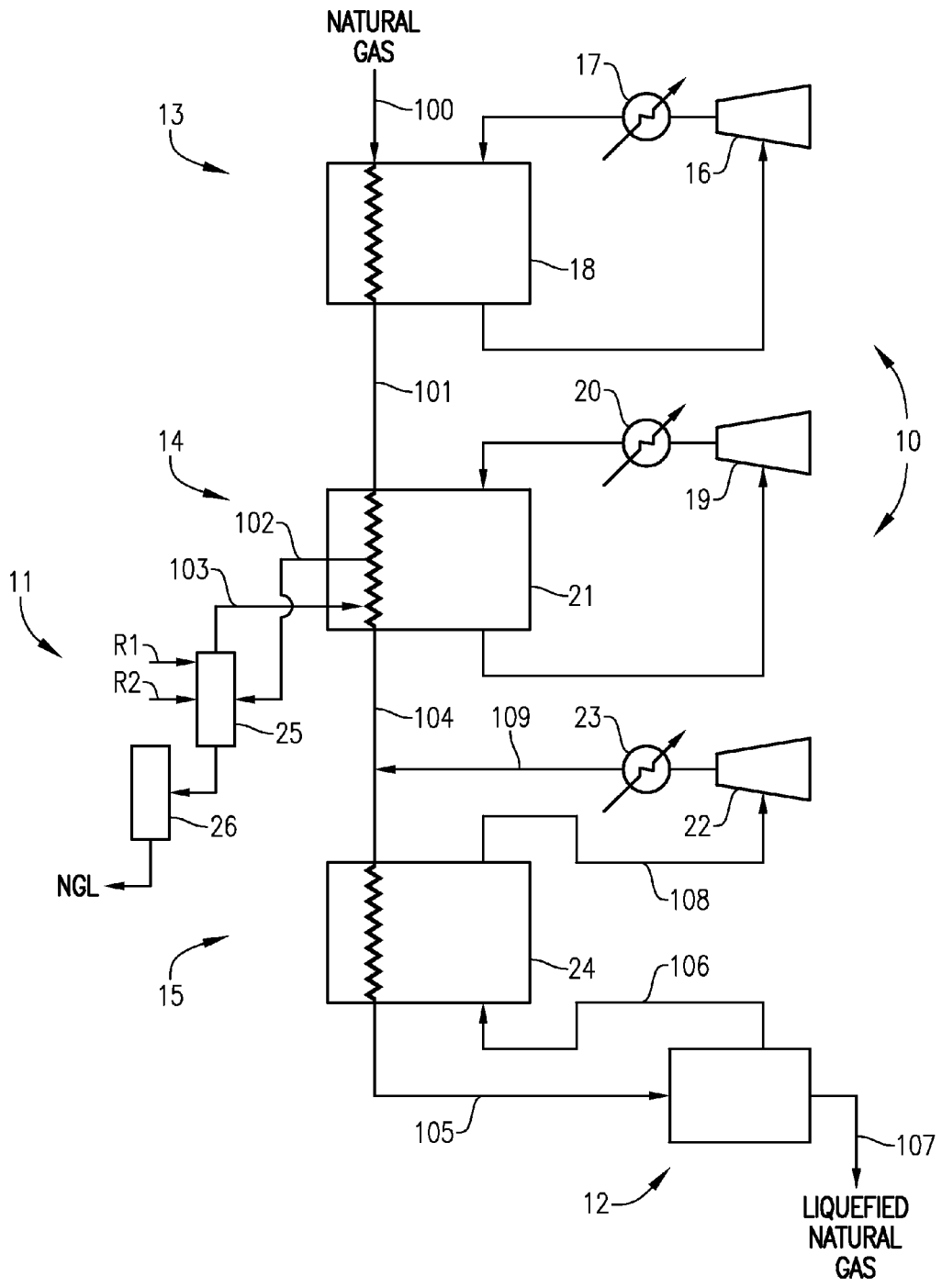
FIG. 1 is a simplified overview of a cascade-type LNG facility configured in accordance with one embodiment of the present invention.

FIG. 1 illustrates one embodiment of a simplified LNG facility employing a dual refluxed heavies removal column. The cascade LNG facility of FIG. 1 generally comprises a cascade cooling section 10, a heavies removal zone 11, and an expansion cooling section 12. Cascade cooling section 10 is depicted as comprising a first mechanical refrigeration cycle 13, a second mechanical refrigeration cycle 14, and a third mechanical refrigeration cycle 15. In general, first, second, and third refrigeration cycles 13, 14, 15 can be closed-loop refrigeration cycles, open-loop refrigeration cycles, or any combination thereof. In one embodiment of the present invention, first and second refrigeration cycles 13 and 14 can be closed-loop cycles, and third refrigeration cycle 15 can be an open-loop cycle that utilizes a refrigerant comprising at least a portion of the natural gas feed stream undergoing liquefaction.

In accordance with one embodiment of the present invention, first, second, and third refrigeration cycles 13, 14, 15 can employ respective first, second, and third refrigerants having successively lower boiling points. For example, the first, second, and third refrigerants can have mid-range boiling points at standard pressure (i.e., mid-range standard boiling points) within about 20° F., within about 10° F., or within 5° F. of the standard boiling points of propane, ethylene, and methane, respectively. In one embodiment, the first refrigerant can comprise at least about 75 mole percent, at least about 90 mole percent, at least 95 mole percent, or can consist essentially of propane, propylene, or mixtures thereof. The second refrigerant can comprise at least about 75 mole percent, at least about 90 mole percent, at least 95 mole percent, or can consist essentially of ethane, ethylene, or mixtures thereof. The third refrigerant can comprise at least about 75 mole percent, at least about 90 mole percent, at least 95 mole percent, or can consist essentially of methane.

As shown in FIG. 1, first refrigeration cycle 13 can comprise a first refrigerant compressor 16, a first cooler 17, and a first refrigerant chiller 18. First refrigerant compressor 16 can discharge a stream of compressed first refrigerant, which can subsequently be cooled and at least partially liquefied in cooler 17. The resulting refrigerant stream can then enter first refrigerant chiller 18, wherein at least a portion of the refrigerant stream can cool the incoming natural gas stream in conduit 100 via indirect heat exchange with the vaporizing first refrigerant. The gaseous refrigerant can exit first refrigerant chiller 18 and can then be routed to an inlet port of first refrigerant compressor 16 to be recirculated as previously described.

First refrigerant chiller 18 can comprise one or more cooling stages operable to reduce the temperature of the incoming natural gas stream in conduit 100 by about 40 to about 210° F., about 50 to about 190° F., or 75 to 150° F. Typically, the natural gas entering first refrigerant chiller 24 via conduit 100 can have a temperature in the range of from about 0 to about 200° F., about 20 to about 180° F., or 50 to 165° F., while the temperature of the cooled natural gas stream exiting first refrigerant chiller 18 can be in the range of from about −65 to about 0° F., about −50 to about −10° F., or −35 to −15° F. In general, the pressure of the natural gas stream in conduit 100 can be in the range of from about 100 to about 3,000 pounds per square inch absolute (psia), about 250 to about 1,000 psia, or 400 to 800 psia. Because the pressure drop across first refrigerant chiller 18 can be less than about 100 psi, less than about 50 psi, or less than 25 psi, the cooled natural gas stream in conduit 101 can have substantially the same pressure as the natural gas stream in conduit 100.

As illustrated in FIG. 1, the cooled natural gas stream (also referred to herein as the "cooled predominantly methane stream") exiting first refrigeration cycle 13 can then enter second refrigeration cycle 14, which can comprise a second refrigerant compressor 19, a second cooler 20, and a second refrigerant chiller 21. Compressed refrigerant can be discharged from second refrigerant compressor 19 and can subsequently be cooled and at least partially liquefied in cooler 20 prior to entering second refrigerant chiller 21. Second refrigerant chiller 21 can employ a plurality of cooling stages to progressively reduce the temperature of the predominantly methane stream in conduit 101 by about 50 to about 180° F., about 65 to about 150° F., or 95 to 125° F. via indirect heat exchange with the vaporizing second refrigerant. As shown in FIG. 1, the vaporized second refrigerant can then be returned to an inlet port of second refrigerant compressor 19 prior to being recirculated in second refrigeration cycle 14, as previously described.

The natural gas feed stream in conduit 100 will usually contain ethane and heavier components ($C_2$+), which can result in the formation of a $C_2$+ rich liquid phase in one or more of the cooling stages of second refrigeration cycle 14. In order to remove the undesired heavies material from the predominantly methane stream prior to complete liquefaction, at least a portion of the natural gas stream passing through second refrigerant chiller 21 can be withdrawn via conduit 102 and processed in heavies removal zone 11 as shown in FIG. 1. The natural gas stream in conduit 102 can have a temperature in the range of from about −160 to about −50° F. about −140 to about −65° F. or −115 to −85° F. and a pressure that is within about 5 percent, about 10 percent, or 15 percent of the pressure of the natural gas feed stream in conduit 100.

Heavies removal zone 11 can comprise one or more gas-liquid separators operable to remove at least a portion of the heavy hydrocarbon material from the predominantly methane natural gas stream. In one embodiment, as depicted in FIG. 1, heavies removal zone comprises a first distillation column 25 and a second distillation column 26. First distillation column 25, also referred to herein as the "heavies removal column," functions primarily to remove the bulk of the heavy hydrocarbon material, especially components with molecular weights greater than hexane (i.e., $C_6$+ material) and aromatics such as benzene, toluene, and xylene, which will freeze in downstream processing equipment. The overhead stream exiting heavies removal column 25 via conduit 103 can comprise at least about 75 percent, at least about 85 percent, at least about 95 percent, or at least 99 mole percent methane. Typically, the concentration of $C_6$+ material in the overhead stream exiting heavies removal column 25 via in conduit 103 can be less than about 0.1 weight percent, less than about 0.05 weight percent, less than about 0.01 weight percent, or less than 0.005 weight percent, based on the total weight of the stream. Generally, heavies removal column 25 can operate with an overhead temperature in the range of from about −200 to about −75° F., about −185 to about −90° F., or about −170 to about −110° F. and an overhead pressure in the range of from about 20 to about 70 bar gauge (barg), about 25 to about 65 barg, or 35 to 60 barg.

As illustrated in FIG. 1, a heavies-rich stream having a temperature in the range of from about −20 to about −100° F., about −35 to about −85° F., or −45 to −65° F. can be routed from first distillation column 25 into second distillation column 26. Second distillation column 26, also referred to herein as the "NGL recovery column," concentrates residual hears hydrocarbon components into an NGL product stream. Examples of typical hydrocarbon components included in NGL streams can include ethane, propane, butane isomers, pentane isomers, and $C_6$+ material. The operating conditions (e.g., overhead temperature and pressure) of second distillation column 26 can vary according to the degree of NGL recovery desired. In one embodiment, NGL recovery column 26 can have an overhead temperature in the range of from about −50 to about 120° F., about −25 to about 75° F. or −10 to 50° F. and an overhead pressure in the range of from about 5 to about 50 barg, about 10 to about 40 barg, or 15 to 30 barg. The extent of NGL recovery can ultimately impact one or more final characteristics of the LNG product, such as, for example, Wobbe index, BTU content, higher heating value (HHV), ethane content, and the like. In one embodiment, the NGL product stream exiting heavies removal zone 11 can be subjected to further fractionation (not shown) in order to obtain one or more substantially pure component streams. Often, NGL and/or the substantially pure product streams derived therefrom can be desirable blendstocks for gasoline and other fuels.

In one embodiment of the present invention, heavies removal column 25 can employ two or more reflux streams, introduced via conduits R1 and R2, having different compositions. For example, the second reflux in conduit R2 stream can have a higher molecular weight than the first reflux stream in conduit R1. In one embodiment, the second reflux stream can have an average molecular weight that is about 10 percent greater, about 25 percent greater, or about 50 percent greater than the average molecular weight of the first reflux stream. Typically, the first reflux stream can have an average molecular weight less than about 24 grams per mole, or in the range of from about 14 to about 22, or 16 to 20 grams per mole, while the second reflux stream can have an average molecular weight less than about 52 grams per mole, or in the range of from about 18 to about 42, or 24 to 36 grams per mole. In addition, each reflux stream can comprise one or more different chemical components. For example, the first reflux stream can comprise at least about 85, at least about 90, at least about 95, at least about 98, or at least 99 mole percent methane, based on the total moles of the stream. The second reflux stream can comprise at least about 15, at least about 25, at least about 40, or at least 50 mole percent ethane, based on the total moles of the stream, and/or less than about 60, less than about 40, less than about 25, less than about 10, or less than 5 mole percent propane and heavier components, based on the total moles of the stream. Employing multiple reflux streams having different compositions can alter the critical point of the fluids within the column, thereby allowing the distillation column to operate at higher pressures while effectively minimizing separation efficiency reduction. In one embodiment of the present invention, the fluids in dual-refluxed heavies removal column 25 can have a critical pressure that is at least about 2 percent, at least about 5 percent, at least about 10 percent, or at least 15 percent higher than the overhead operating pressure of the distillation column.

In general, the first reflux stream in conduit R1 can be introduced into heavies removal column 25 near the upper portion of the column, while the second reflux stream in conduit R2 can be introduced at a lower elevation than the first reflux stream, as illustrated in FIG. 1. The absolute positions of the first and second reflux streams can be adjusted according to the specific compositions of each reflux stream, the column feed stream, and/or the desired characteristics of one or more product streams withdrawn from heavies removal column 25. In order to achieve a desired temperature and/or pressure profile within heavies removal column 25, the first reflux stream can have a temperature in the range of from about −60 to about −175° F., about −85 to about −150° F., or −115 to −130° F. and the second reflux stream can have a temperature in the range of from about −40 to about −160° F., −60 to −140° F., or −80 to −115° F.

As shown in FIG. 1, a heavies-depleted, predominantly methane stream can be withdrawn from heavies removal column 25 via conduit 103 and can be routed back to second refrigeration cycle 14. The stream in conduit 103 can have a temperature in the range of from about −140 to about −50° F., about −125 to about −60° F., or −110 to −75° F. and a pressure in the range of from about 200 to about 1,200 psia, about 350 to about 850 psia, or 500 to 700 psia. As shown in FIG. 1, the predominantly methane stream in conduit 103 can subsequently be further cooled via second refrigerant chiller 21. In one embodiment, the stream exiting second refrigerant chiller 21 via conduit 104 can be completely liquefied and can have a temperature in the range of from about −205 to about −70°

F., about −175 to about −95° F., or −140 to −125° F. Generally, the stream in conduit 104 can be at approximately the same pressure the natural gas stream entering the LNG facility in conduit 100.

As illustrated in FIG. 1, the pressurized LNG-bearing stream in conduit 104 can combine with a yet-to-be-discussed stream in conduit 109 prior to entering third refrigeration cycle 15, which is depicted as generally comprising a third refrigerant compressor 22, a cooler 23, and a third refrigerant chiller 24. Compressed refrigerant discharged from third refrigerant compressor 22 enters cooler 23, wherein the refrigerant stream is cooled and at least partially liquefied prior to entering third refrigerant chiller 24. Third refrigerant chiller 24 can comprise one or more cooling stages operable to subcool the pressurized predominantly methane stream via indirect heat exchange with the vaporizing refrigerant. In one embodiment, the temperature of the pressurized LNG-bearing stream can be reduced by about 2 to about 60° F., about 5 to about 50° F. or 10 to 40° F. in third refrigerant chiller 24. In general, the temperature of the pressurized LNG-bearing stream exiting third refrigerant chiller 24 via conduit 105 can be in the range of from about −275 to about −75° F., about −225 to about −100° F. or −200 to −125° F.

As shown in FIG. 1, the pressurized LNG-bearing stream in conduit 105 can be then routed to expansion cooling section 119 wherein the stream is subcooled via sequential pressure reduction to near atmospheric pressure by passage through one or more expansion stages. In one embodiment, each expansion stage can reduce the temperature of the LNG-bearing stream by about 10 to about 60° F., about 15 to about 50° F., or 20 to 40° F. Each expansion stage comprises one or more expanders, which reduce the pressure of the liquefied stream to thereby evaporate or flash a portion thereof. Examples of suitable expanders can include, but are not limited to, Joule-Thompson valves, venturi nozzles, and turboexpanders. Expansion section 12 can employ any number of expansion stages and one or more expansion stages may be integrated with one or more cooling stages of third refrigerant chiller 24. In one embodiment of the present invention, expansion section 12 can reduce the pressure of the LNG-bearing stream in conduit 105 by about 75 to about 450 psi, about 125 to about 300 psi, or 150 to 225 psi.

Each expansion stage may additionally employ one or more vapor-liquid separators operable to separate the vapor phase (i.e., the flash gas stream) from the cooled liquid stream. As previously discussed, third refrigeration cycle 15 can comprise an open-loop refrigeration cycle, closed-loop refrigeration cycle, or any combination thereof. When third refrigeration cycle 15 comprises a closed-loop refrigeration cycle, the flash gas stream can be used as fuel within the facility or routed downstream for storage, further processing, and/or disposal. When third refrigeration cycle 15 comprises an open-loop refrigeration cycle, at least a portion of the flash gas stream exiting expansion section 12 can be used as a refrigerant to cool at least a portion of the natural gas stream in conduit 104. Generally, when third refrigerant cycle 15 comprises an open-loop cycle, the third refrigerant can comprise at least 50 weight percent, at least about 75 weight percent, or at least 90 weight percent of flash gas from expansion section 12, based on the total weight of the stream. As illustrated in FIG. 1, the flash gas exiting expansion section 12 via conduit 106 can enter third refrigerant chiller 24, wherein the stream can cool at least a portion of the natural gas stream entering third refrigerant chiller 24 via conduit 104. The resulting warned refrigerant stream can then exit third refrigerant chiller 24 via conduit 108 and can thereafter be routed to an inlet port of third refrigerant compressor 22. As shown in FIG. 1, third refrigerant compressor 22 discharges a stream of compressed third refrigerant, which is thereafter cooled in cooler 23. The resulting cooled methane stream in conduit 109 can then combine with the natural gas stream in conduit 104 prior to entering third refrigerant chiller 24, as previously discussed.

As shown in FIG. 1, the liquid stream exiting expansion section 12 via conduit 107 comprises LNG. In one embodiment, the LNG in conduit 107 can have a temperature in the range of from about −200 to about −300° F. about −225 to about −275° F., or −240 to −260° F. and a pressure in the range of from about 0 to about 40 psia, about 5 to about 25 psia, 10 to 20 psia, or about atmospheric. The LNG in conduit 107 can subsequently be routed to storage and/or shipped to another location via pipeline, ocean-going vessel, truck, or any other suitable transportation means. In one embodiment, at least a portion of the LNG can be subsequently vaporized for uses in applications requiring vapor-phase natural gas.

FIGS. 2*a* through 3*b* present several embodiments of specific configurations of the LNG facility described previously with respect to FIG. 1. To facilitate an understanding of FIGS. 2*a* through 3*b*, the following numeric nomenclature was employed. Items numbered 31 through 49 are process vessels and equipment directly associated with first propane refrigeration cycle 30, and items numbered 51 through 69 are process vessels and equipment related to second ethylene refrigeration cycle 50. Items numbered 71 through 94 correspond to process vessels and equipment associated with third methane refrigeration cycle 70 and/or expansion section 80. Items numbered 100 through 199 correspond to flow lines or conduits that contain predominantly methane streams. Items numbered 200 through 299 correspond to flow lines or conduits which contain predominantly ethylene streams. Items numbered 300 through 399 correspond to flow lines or conduits that contain predominantly propane streams. Items numbered 400 through 449 correspond to flow lines or conduits associated with several embodiments of a heavies removal zone illustrated in FIGS. 2*b* through 2*d*. Items numbered 450 through 499 correspond to process vessels and equipment associated with several embodiments of a heavies removal zone illustrated in FIGS. 2*b* through 2*d*. Items numbered 500 through 545 correspond to flow lines or conduits associated with one embodiment of a heavies removal zone illustrated in FIG. 3*b*, while items numbered 546 through 599 represent process vessels and equipment associated with one embodiment of a heavies removal zone illustrated in FIG. 3*b*. In FIGS. 2*a* through 3*b*, like numerals correspond to like parts.

Figure 2A:
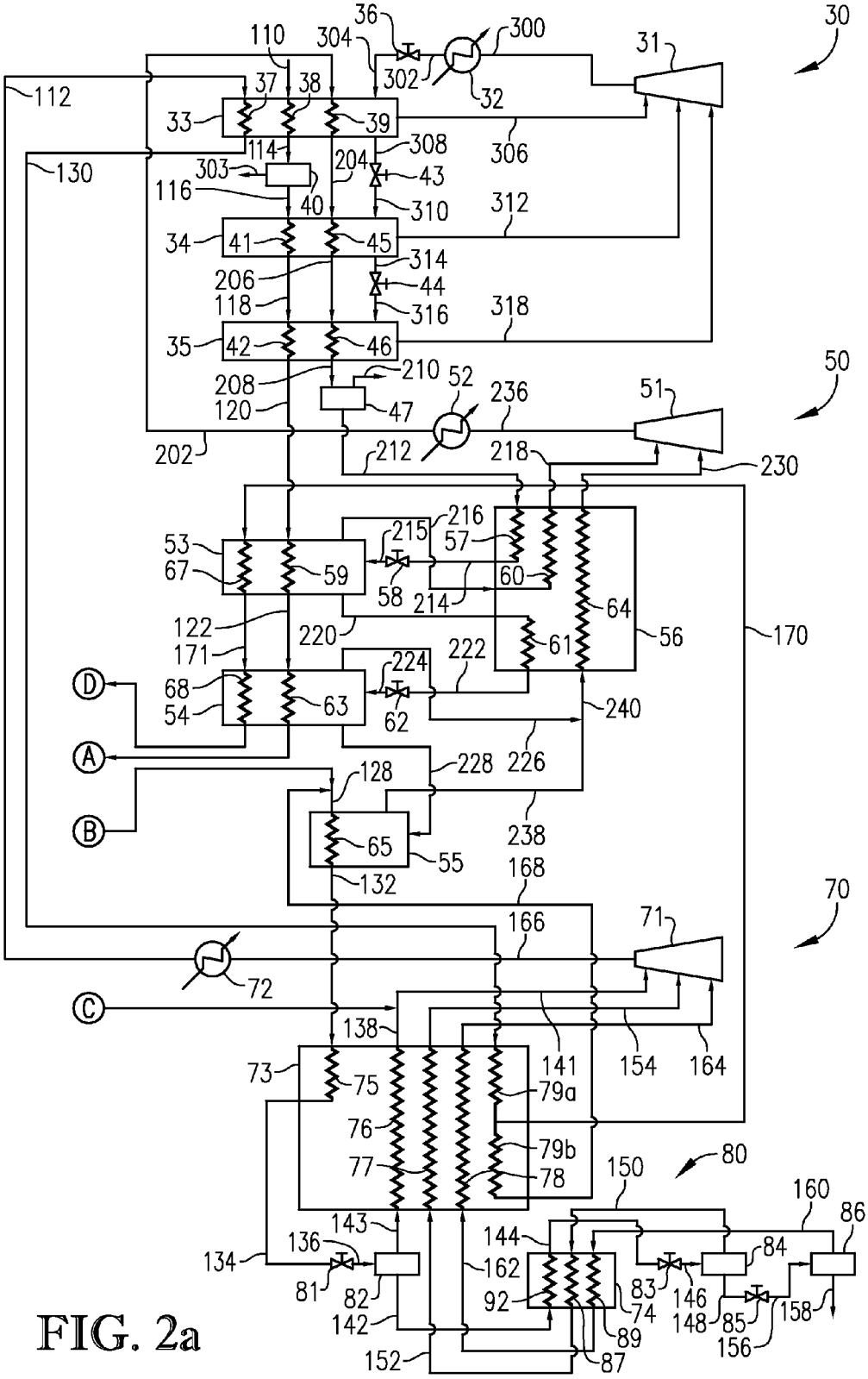
FIG. 2*a* is a schematic diagram a cascade-type LNG facility configured in accordance with one embodiment of present invention with certain portions of the LNG facility connecting to lines A, B, C, and D being illustrated in FIG. 2*b;*

Referring to FIG. 2*a*, a cascade-type LNG facility in accordance with one embodiment of the present invention is illustrated. The LNG facility depicted in FIG. 2*a* generally comprises a propane refrigeration cycle 30, a ethylene refrigeration cycle 50, a methane refrigeration cycle 70 with an expansion section 80, and a heavies removal zone. Several embodiments of heavies removal zones capable of being integrated into the LNG facility illustrated in FIG. 2*a* via lines A, B, C, and D will be discussed in detail shortly with reference to FIGS. 2*b* through 2*d*. While "propane," "ethylene," and "methane" are used to refer to respective first, second, and third refrigerants, it should be understood that the embodiment illustrated in FIG. 2*a* and described herein can apply to any combination of suitable refrigerants. The main components of propane refrigeration cycle 30 include a propane compressor 31, a propane cooler 32, a high-stage propane chiller 33, an intermediate-stage propane chiller 34, and a low-stage propane chiller 35. The main components of ethylene refrigeration cycle 50 include an ethylene compressor 51, an ethylene cooler 52, a high-stage ethylene chiller 53, an intermediate-stage ethylene chiller 54, a low-stage ethylene chiller/condenser 55, and an ethylene economizer 56. The main components of methane refrigeration cycle 70 include a methane compressor 71, a methane cooler 72, a main methane economizer 73, and a secondary methane economizer 74. The main components of expansion section 80 include a high-stage methane expander 81, a high-stage methane flash drum 82, an intermediate-stage methane expander 83, an intermediate-stage methane flash drum 84, a low-stage methane expander 85, and a low-stage methane flash drum 86.

The operation of the LNG facility illustrated in FIG. 2*a* will now be described in more detail, beginning with propane refrigeration cycle 30. Propane is compressed in multi-stage (e.g., three-stage) propane compressor 31 driven by, for example, a gas turbine driver (not illustrated). The three stages of compression preferably exist in a single unit, although each stage of compression may be a separate unit and the units mechanically coupled to be driven by a single driver. Upon compression, the propane is passed through conduit 300 to propane cooler 32, wherein the stream is cooled and liquefied via indirect heat exchange with an external fluid (e.g., air or water). A representative temperature and pressure of the liquefied propane refrigerant exiting cooler 32 is about 100° F. and about 190 psia. The stream from propane cooler 32 can then be passed through conduit 302 to a pressure reduction means, illustrated as expansion valve 36, wherein the pressure of the liquefied propane is reduced, thereby evaporating or flashing a portion thereof. The resulting two-phase stream then flows via conduit 304 into high-stage propane chiller 33. High-stage propane chiller 33 uses indirect heat exchange means 37, 38, and 39 to cool respectively, the incoming gas streams, including a yet-to-be-discussed methane refrigerant stream in conduit 11', a natural gas feed stream in conduit 110, and a yet-to-be-discussed ethylene refrigerant stream in conduit 202 via indirect heat exchange with the vaporizing refrigerant. The cooled methane refrigerant stream exits high-stage propane chiller 33 via conduit 130 and can subsequently be routed to the inlet of main methane economizer 73, which will be discussed in greater detail in a subsequent section.

The cooled natural gas stream from high-stage propane chiller 33 (also referred to herein as the "methane-rich stream") flows via conduit 114 to a separation vessel 40, wherein the gaseous and liquid phases are separated. The liquid phase, which can be rich in propane and heavier components ($C_3$+), is removed via conduit 303. The predominately vapor phase exits separator 40 via conduit 116 and can then enter intermediate-stage propane chiller 34, wherein the stream is cooled in indirect heat exchange means 41 via indirect heat exchange with a yet-to-be-discussed propane refrigerant stream. The resulting two-phase methane-rich stream in conduit 118 can then be routed to low-stage propane chiller 35, wherein the stream can be further cooled via indirect heat exchange means 42. The resultant predominantly methane stream can then exit low-stage propane chiller 34 via conduit 120. Subsequently, the cooled methane-rich stream in conduit 120 can be routed to high-stage ethylene chiller 53, which will be 110 discussed in more detail shortly.

The vaporized propane refrigerant exiting high-stage propane chiller 33 is returned to the high-stage inlet port of propane compressor 31 via conduit 306. The residual liquid propane refrigerant in high-stage propane chiller 33 can be passed via conduit 308 through a pressure reduction means, illustrated here as expansion valve 43, whereupon a portion of the liquefied refrigerant is flashed or vaporized. The resulting cooled, two-phase refrigerant stream can then enter intermediate-stage propane chiller 34 via conduit 310, thereby providing coolant for the natural gas stream and yet-to-be-discussed ethylene refrigerant stream entering intermediate-stage propane chiller 34. The vaporized propane refrigerant exits intermediate-stage propane chiller 34 via conduit 312 and can then enter the intermediate-stage inlet port of propane compressor 31. The remaining liquefied propane refrigerant exits intermediate-stage propane chiller 34 via conduit 314 and is passed through a pressure-reduction means, illustrated here as expansion valve 44, whereupon the pressure of the stream is reduced to thereby flash or vaporize a portion thereof. The resulting vapor-liquid refrigerant stream then enters low-stage propane chiller 35 via conduit 316 and cools the methane-rich and yet-to-be-discussed ethylene refrigerant streams entering low-stage propane chiller 35 via conduits 118 and 206, respectively. The vaporized propane refrigerant stream then exits low-stage propane chiller 35 and is routed to the low-stage inlet port of propane compressor 31 via conduit 318 wherein it is compressed and recycled as previously described.

As shown in FIG. 2*a*, a stream of ethylene refrigerant in conduit 202 enters high-stage propane chiller, wherein the ethylene stream is cooled via indirect heat exchange means 39. The resulting cooled stream in conduit 204 then exits high-stage propane chiller 33, whereafter the at least partially condensed stream enters intermediate-stage propane chiller 34. Upon entering intermediate-stage propane chiller 34, the ethylene refrigerant stream can be further cooled via indirect heat exchange means 45. The resulting two-phase ethylene stream can then exit intermediate-stage propane chiller 34 prior to entering low-stage propane chiller 35 via conduit 206. In low-stage propane chiller 35, the ethylene refrigerant stream can be at least partially condensed, or condensed in its entirety, via indirect heat exchange means 46. The resulting stream exits low-stage propane chiller 35 via conduit 208 and can subsequently be routed to a separation vessel 47, wherein the vapor portion of the stream, if present, can be removed via conduit 210. The liquefied ethylene refrigerant stream exiting separator 47 via conduit 212 can have a representative temperature and pressure of about −24° F. and about 285 psia.

Turning now to ethylene refrigeration cycle 50 in FIG. 2*a*, the liquefied ethylene refrigerant stream in conduit 212 can enter ethylene economizer 56, wherein the stream can be further cooled by an indirect heat exchange means 57. The sub-cooled liquid ethylene stream in conduit 214 can then be routed through a pressure reduction means, illustrated here as expansion valve 58, whereupon the pressure of the stream is reduced to thereby flash or vaporize a portion thereof. The cooled, two-phase stream in conduit 215 can then enter high-stage ethylene chiller 53, wherein at least a portion of the ethylene refrigerant stream can vaporize to thereby cool the methane-rich stream in conduit 120 and the yet-to-be-discussed stream in conduit 170 via respective indirect heat exchange means 59 and 67. The vaporized and remaining liquefied refrigerant exit high-stage ethylene chiller 53 via respective conduits 216 and 220. The vaporized ethylene refrigerant in conduit 216 can re-enter ethylene economizer 56, wherein the stream can be warmed via an indirect heat exchange means 60 prior to entering the high-stage inlet port of ethylene compressor 51 via conduit 218, as shown in FIG. 2*a*.

The remaining liquefied refrigerant in conduit 220 can re-enter ethylene economizer 56, wherein the stream can be further cooled by an indirect heat exchange means 61. The resulting sub-cooled refrigerant stream exits ethylene economizer 56 via conduit 222 and can subsequently be routed to a pressure reduction means, illustrated here as expansion valve 62, whereupon the pressure of the stream is reduced to thereby vaporize or flash a portion thereof. The resulting, cooled two-phase stream in conduit 224 enters intermediate-stage ethylene chiller 54, wherein the refrigerant stream can cool the natural gas stream in conduit 122 and a yet-to-be-discussed stream in conduit 171 via respective indirect heat exchange means 63 and 68. As shown in FIG. 2*a*, the resulting cooled methane-rich stream exiting intermediate-stage ethylene chiller 54 enters conduit A, which can then transport the predominantly methane stream to the heavies removal zone. The configuration and operation of several embodiments of a heavies removal zone will be discussed in detail shortly with reference to FIGS. 2*b* through 2*d*.

The vaporized ethylene refrigerant exits intermediate-stage ethylene chiller 54 via conduit 226, whereafter the stream can combine with a yet-to-be-discussed ethylene vapor stream in conduit 238. The combined stream in conduit 240 can enter ethylene economizer 56, wherein the stream is warmed in an indirect heat exchange means 64 prior to being fed into the low-stage inlet port of ethylene compressor 51 via conduit 230. As shown in FIG. 2*a*, a stream of compressed ethylene refrigerant in conduit 236 can subsequently be routed to ethylene cooler 52, wherein the ethylene stream can be cooled via indirect heat exchange with an external fluid (e.g., water or air). The resulting, at least partially condensed ethylene stream can then be introduced via conduit 202 into high-stage propylene chiller 33 for additional cooling as previously described.

The remaining liquefied ethylene refrigerant exits intermediate-stage ethylene chiller 54 via conduit 228 prior to entering low-stage ethylene chiller/condenser 55, wherein the refrigerant can cool the methane-rich stream entering low-stage ethylene chiller/condenser via conduit 128 in an indirect heat exchange means 65. In one embodiment shown in FIG. 2*a*, the stream in conduit 128 results from the combination of a heavies-depleted (i.e., light hydrocarbon rich) stream exiting the heavies removal zone depicted in FIG. 2*b* in conduit B and a yet-to-be-discussed methane refrigerant stream in conduit 168. As shown in FIG. 2*a*, the vaporized ethylene refrigerant can then exit low-stage ethylene chiller/condenser 55 via conduit 238 prior to combining with the vaporized ethylene exiting intermediate-stage ethylene chiller 54 and entering the low-stage inlet port of ethylene compressor 51, as previously discussed.

The cooled natural gas stream exiting low-stage ethylene chiller/condenser 55 can also be referred to as the "pressurized LNG-bearing stream." As shown in FIG. 2*a*, the pressurized LNG-bearing stream exits tow-stage ethylene chiller/condenser 55 via conduit 132 prior to entering main methane economizer 73. In main methane economizer 73 the methane-rich stream can be cooled in an indirect heat exchange means 75 via indirect heat exchange with one or more yet-to-be discussed methane refrigerant streams. The cooled, pressurized LNG-bearing stream exits main methane economizer 73 and can then be routed via conduit 134 into expansion section 80 of methane refrigeration cycle 70. In expansion section 80, the cooled predominantly methane stream passes through high-stage methane expander 81, whereupon the pressure of the stream is reduced to thereby vaporize or flash a portion thereof. The resulting two-phase methane-rich stream in conduit 136 can then enter high-stage methane flash drum 82, whereupon the vapor and liquid portions can be separated. The vapor portion exiting high-stage methane flash drum 82 (i.e., the high-stage flash gas) via conduit 143 can then enter main methane economizer 73, wherein the stream is heated via indirect heat exchange means 76. The resulting warmed vapor stream in conduit 138 exits main methane economizer 73 and subsequently combines with a yet-to-be-discussed vapor stream exiting the heavies removal zone illustrated in FIG. 2*b* via conduit C. The combined stream in conduit 141 can then be routed to the high-stage inlet port of methane compressor 71, as shown in FIG. 2*a*.

The liquid phase exiting high-stage methane flash drum 82 via conduit 142 can enter secondary methane economizer 74, wherein the methane stream can be cooled via indirect heat exchange means 92. The resulting cooled stream in conduit 144 can then be routed to a second expansion stage, illustrated here as intermediate-stage expander 83. Intermediate-stage expander 83 reduces the pressure of the methane stream passing therethrough to thereby reduce the stream's temperature by vaporizing or flashing a portion thereof. The resulting two-phase methane-rich stream in conduit 146 can then enter intermediate-stage methane flash drum 84 wherein the liquid and vapor portions of the stream can be separated and can exit the intermediate-stage flash drum via respective conduits 148 and 150. The vapor portion (i.e., the intermediate-stage flash gas) in conduit 150 can re-enter secondary methane economizer 74, wherein the stream can be heated via an indirect heat exchange means 87. The warmed stream can then be routed via conduit 152 to main methane economizer 73, wherein the stream can be further warmed via an indirect heat exchange means 78 prior to entering the intermediate-stage inlet port of methane compressor 71 via conduit 154.

The liquid stream exiting intermediate-stage methane flash drum 84 via conduit 148 can then pass through a low-stage expander 85, whereupon the pressure of the liquefied methane-rich stream can be further reduced to thereby vaporize or flash a portion thereof. The resulting cooled, two-phase stream in conduit 156 can then enter low-stage methane flash drum 86, wherein the vapor and liquid phases can be separated. The liquid stream exiting low-stage methane flash drum 86 can comprise the liquefied natural gas (LNG) product. The LNG product, which is at about atmospheric pressure, can be routed via conduit 158 downstream for subsequent storage, transportation, and/or use.

The vapor stream exiting low-stage methane flash drum 86 (i.e., the low-stage methane flash gas) in conduit 160 can be routed to secondary methane economizer 74, wherein the stream can be warmed via an indirect heat exchange means 89. The resulting stream can exit secondary methane economizer 74 via conduit 162, whereafter the stream can be routed to main methane economizer 73 to be further heated via indirect heat exchange means 78. The warmed methane vapor stream can then exit main methane economizer 73 via conduit 164 prior to being routed to the low-stage inlet port of methane compressor 71. Methane compressor 71 can comprise one or more compression stages. In one embodiment, methane compressor 71 comprises three compression stages in a single module. In another embodiment, the compression modules can be separate, but can be mechanically coupled to a common driver. Generally, when methane compressor 71 comprises two or more compression stages, one or more intercoolers (not shown) can be provided between subsequent compression stages. As shown in FIG. 2*a*, the compressed methane refrigerant stream exiting methane compressor 71 can be discharged into conduit 166, whereafter the stream can be cooled via indirect heat exchange with an external fluid (e.g., air or water) in methane cooler 72. The cooled methane refrigerant stream exiting methane cooler 72 can then enter conduit 112, whereafter the methane refrigerant stream can be further cooled in propane refrigeration cycle 30, as described in detail previously.

Upon being cooled in propane refrigeration cycle 30, the methane refrigerant stream can be discharged into conduit 130 and subsequently routed to main methane economizer 73, wherein the stream can be further cooled via indirect heat exchange means 79*a*. The cooled stream exiting indirect heat exchange means 79*a* can subsequently be split into a first portion and a second portion. The first portion can be further cooled via an indirect heat exchange means 79*b* and can exit main methane economizer 73 via conduit 168 prior to combining with the heavies-depleted stream exiting the heavies removal zone shown in FIG. 2*b* through 2*d* in conduit A, as previously discussed.

As shown in FIG. 2*a*, the second portion of the stream exiting indirect heat exchange means 79*a* can exit main methane economizer 73 via conduit 170 and can subsequently be routed to high-stage ethylene chiller 53, wherein the stream can be further cooled via an indirect heat exchange means 67. The resulting cooled stream can then be routed via conduit 171 to intermediate-stage ethylene chiller 54, wherein the stream can be further sub-cooled via indirect heat exchange means 68. As shown in FIG. 2*a*, the stream exiting intermediate-stage ethylene chiller 54 via conduit D can then be routed to the heavies removal zone illustrated in FIGS. 2*b* through 2*d*, which will be discussed in detail shortly.

Figure 2B:
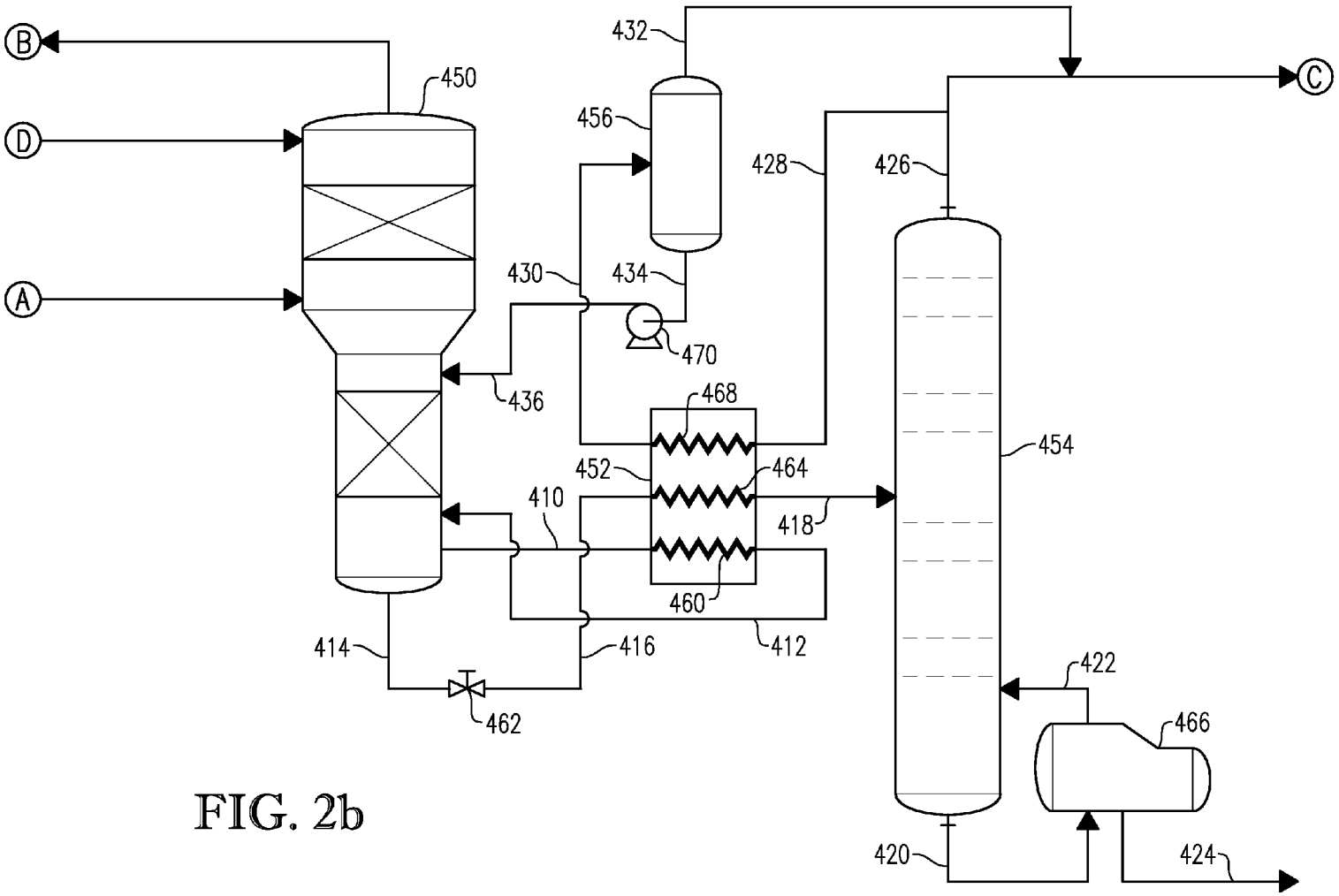
FIG. 2*b* is a schematic diagram illustrating one embodiment of a heavies removal zone integrated into the LNG facility of FIG. 2*a* via lines A, B, C, and D.

Referring now to FIG. 2*b*, a heavies removal zone in accordance with one embodiment of the present invention is illustrated as generally comprising a first distillation column 450, a heat exchanger 452, a second distillation column 454, and a vapor-liquid separator 456. The heavies removal zone depicted in FIG. 2*b* can be integrated into the LNG facility illustrated in FIG. 2*a* via lines A, B, C, and D. Turning now to the operation of the heavies removal zone illustrated in FIG. 2*b*, the predominantly methane stream exiting intermediate-stage ethylene chiller 54 shown in FIG. 2*a* enters first distillation column 450, also referred to herein as "heavies removal column" 450 via conduit A. A predominantly vapor, methane rich overhead stream can be withdrawn from an upper outlet of heavies removal column 450 via conduit B. The stream in conduit B can then combine with the methane refrigerant stream in conduit 168, and the resulting combined stream can then be cooled via methane refrigeration cycle 70, as previously discussed with respect to FIG. 2*a*.

As illustrated in FIG. 2*b*, the subcooled predominantly liquid reflux stream in conduit D entering the heavies removal zone from the intermediate-stage ethylene chiller 54 in FIG. 2*a* can enter a reflux inlet located near the upper portion of heavies removal column 450. In one embodiment, depicted in FIG. 2*b*, a yet-to-be-discussed second reflux stream in conduit 436 can be introduced below the predominantly methane feed stream entering a fluid inlet of heavies removal column 450. A predominantly liquid bottoms stream can be withdrawn from a lower outlet near the lower portion of heavies removal column 450 via conduit 410 and can subsequently be heated in heat exchanger 452 via an indirect heat exchange means 460. The resultant, at least partially vaporized stream can then be reintroduced into the lower portion of heavies removal column 450 via conduit 412 in order to provide at least a portion of the heating duty for the column.

As shown in FIG. 2*b*, a predominantly liquid bottoms product can be withdrawn from a lower outlet of heavies removal column 450 via conduit 414 and can subsequently be passed through a pressure reduction means, illustrated herein as expander 462, wherein the pressure of the stream is reduced to thereby vaporize or flash a portion thereof. The resulting two-phase stream in conduit 416 can then enter heat exchanger 452, wherein the stream can be warmed via indirect heat exchange means 464. The resulting, warmed stream in conduit 418 can subsequently be introduced into second distillation column 454 via conduit 422. As illustrated in FIG. 2*b*, a predominantly liquid bottoms stream can be withdrawn from a lower product outlet of second distillation column 454 via conduit 420, whereafter the stream can be at least partially vaporized in heat exchanger 466 via indirect heat exchange with an external fluid (e.g., steam or other heated heat transfer medium). At least a portion of the vaporized stream exiting heat exchanger 466 can subsequently be returned to second distillation column 454 via conduit 422 to provide at least a portion of the overall heat duty. The remaining liquid portion (i.e., the NGL product stream) exits heat exchanger 466 via conduit 424 and can then be routed to further processing, storage, and/or use.

According to FIG. 2*b*, a predominantly vapor overhead product stream exits the upper outlet of second distillation column 454 via conduit 426 can thereafter be divided into two portions. The first portion in conduit C can exit the heavies removal zone depicted in FIG. 2*b* and can combine with the warmed high-stage flash gas exiting main methane economizer 73 in conduit 138 as shown and described earlier with respect to FIG. 2*a*. The second portion of the overhead product stream from second distillation column 454 in conduit 428 can enter heat exchanger 452, wherein the stream can be cooled via an indirect heat exchange means 468. The resulting two-phase stream can exit heat exchanger 452 via conduit 430 and can then be routed to vapor-liquid separator 456, wherein the vapor and liquid phases can be separated. The vapor phase exits vapor-liquid separator 456 via conduit 432 and thereafter combines with the first portion of the overhead stream exiting second distillation column 454 in conduit C prior to exiting the heavies removal zone as previously discussed. The liquid stream withdrawn from a lower outlet of vapor-liquid separator 456 via conduit 434 can be routed into the suction of a reflux pump 470. The reflux pump increases the pressure of the sub-cooled, predominantly liquid stream, which can then be discharged into conduit 436. Thereafter, at least a portion of the stream in conduit 436 can be introduced into a reflux inlet of heavies removal column 450 as a second reflux stream.

Figure 2C:
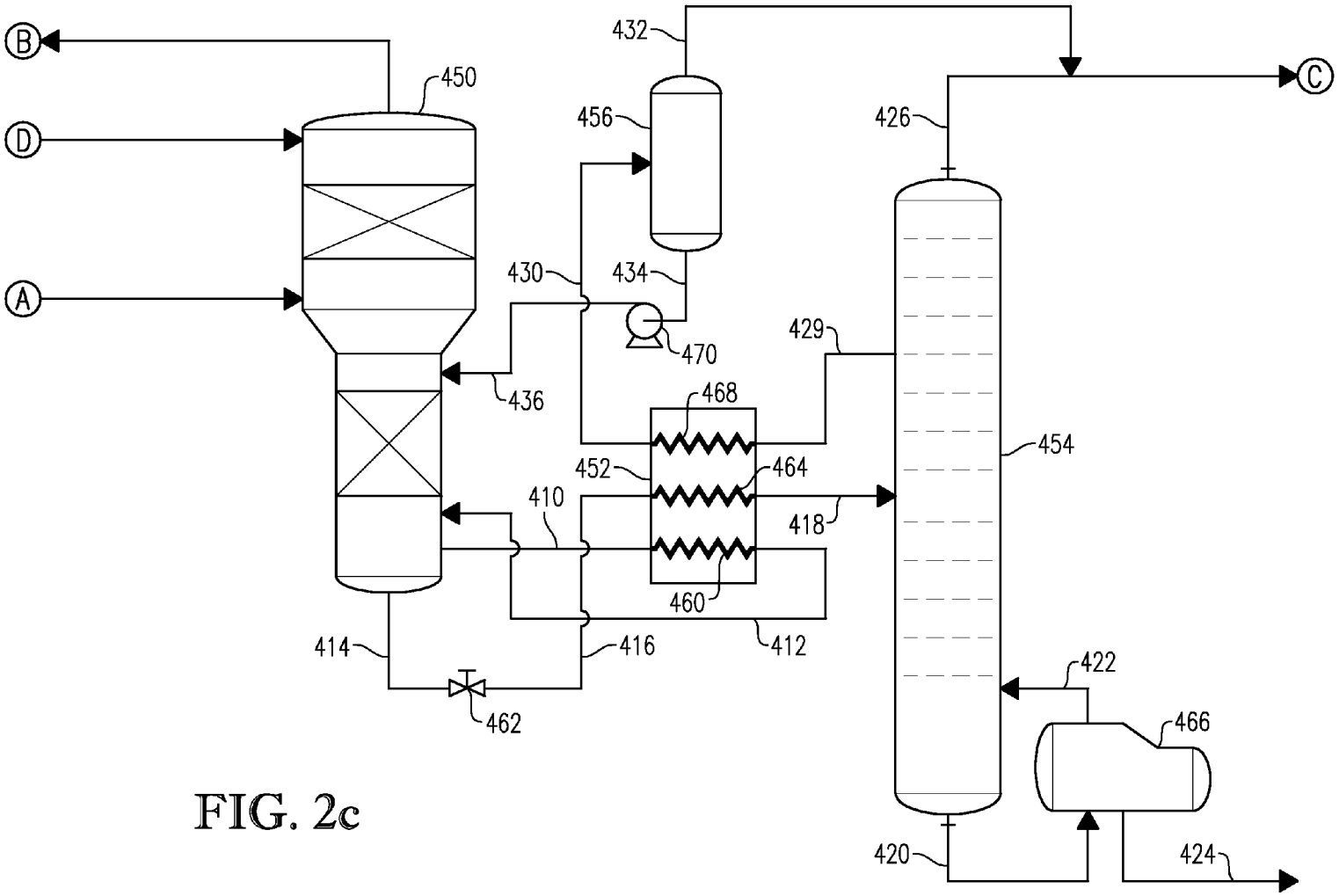
FIG. 2*c* is a schematic diagram illustrating another embodiment of a heavies removal zone integrated into the LNG facility of FIG. 2*a* via lines A, B, C, and D.

Referring now to FIG. 2*c*, a heavies removal zone according to another embodiment of the present invention is presented. The heavies removal zone depicted in FIG. 2*c* can be integrated into the LNG facility illustrated in FIG. 2*a* via lines A, B, C, and D. The main components and the operation of the heavies removal zone in FIG. 2*c* are the same as those previously described with respect to FIG. 2*b*. However, according to the embodiment illustrated in FIG. 2*c*, the second reflux stream employed in heavies removal column 450 can originate from a side stream withdrawn from second distillation column 454. As shown in FIG. 2*c*, the side draw removed from second distillation column 454 via conduit 429 can be cooled and separated as previously described with respect to FIG. 2*b* prior to entering a reflux inlet of heavies removal column 450 via conduit 436.

Figure 2D:
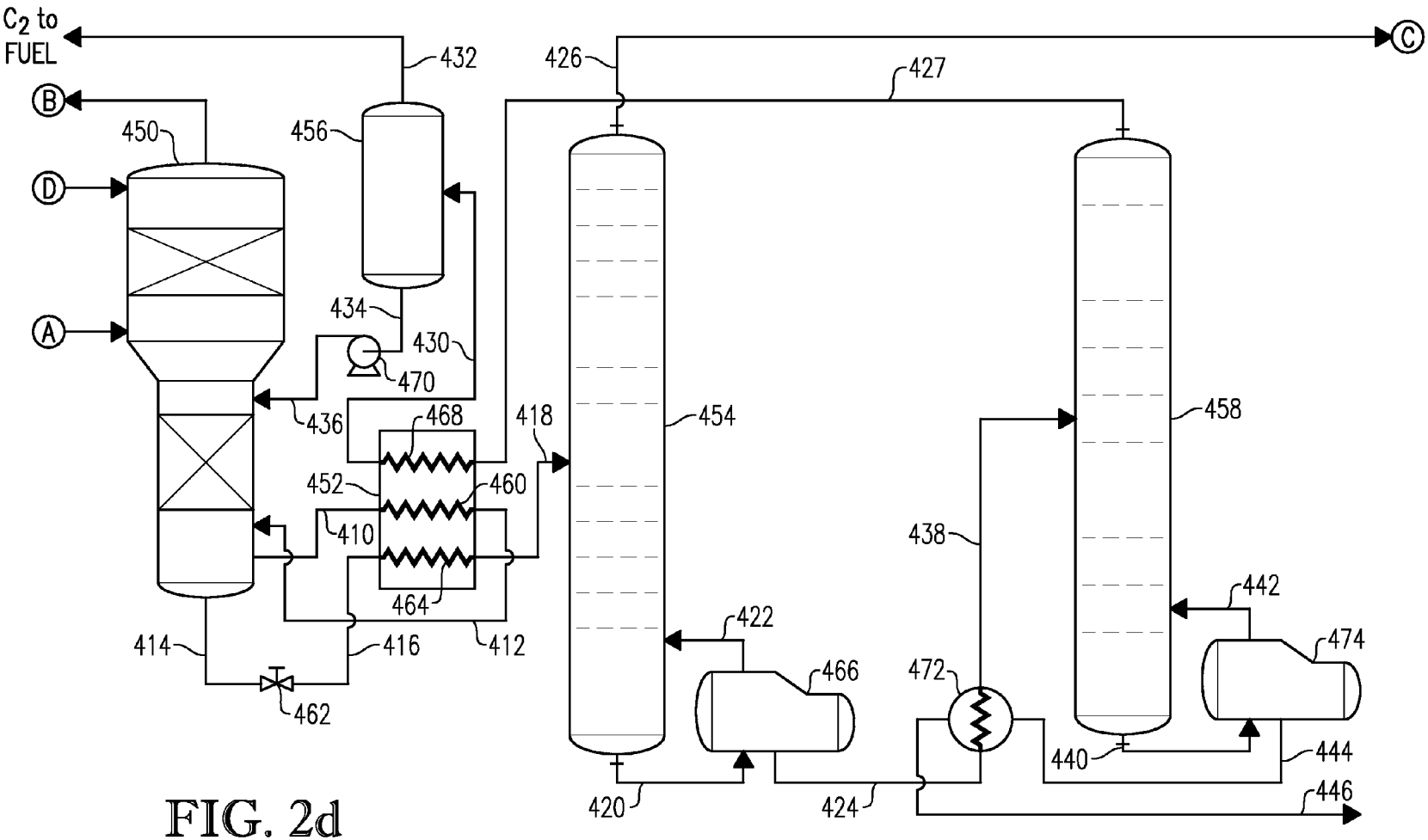
FIG. 2*d* is a schematic diagram illustrating yet another embodiment of a heavies removal zone integrated into the LNG facility of FIG. 2*a* via lines A, B, C, and D.

Referring now to FIG. 2*d*, a heavies removal zone in accordance with yet another embodiment of the present invention is shown. The heavies removal zone depicted in FIG. 2*d* can be integrated into the LNG facility illustrated in FIG. 2*a* via lines A, B, C, and D. The main components of the system illustrated in FIG. 2*d* are the same as described with respect to FIG. 2*b* and additionally include a third distillation column 458. The operation of the system illustrated in FIG. 2*d*, as it differs from the operation of the system previously described with respect to FIG. 2*b*, will now be described in detail.

As shown in FIG. 2*d*, a stream in conduit 418 exiting neat exchanger 452 can be introduced into a fluid inlet of second distillation column 454. The predominantly vapor overhead stream withdrawn from an upper outlet of second distillation column 454 via conduit 426 can subsequently be routed via conduit C to the methane refrigeration cycle and combine with the high-stage methane vapor stream exiting main methane economizer 73 as discussed previously with respect to FIGS. 2*a* and 2*b*. As illustrated in FIG. 2*d*, a predominantly liquid bottoms stream can be withdrawn from a lower outlet of second distillation column 454 via conduit 420, whereafter the stream can be at least partially vaporized in heat exchanger 466 via indirect heat exchange with an external fluid (e.g., steam or other heated heat transfer medium). The liquid portion exiting heat exchanger 466 via conduit 424 can enter a heat exchanger 472, wherein the stream can be heated via indirect heat exchange with a yet-to-be-discussed stream in conduit 444. The warmed stream in conduit 438 can then enter a fluid inlet of third distillation column 458.

As illustrated in FIG. 2*d*, the bottoms product withdrawn from a lower outlet of third distillation column 458 via conduit 440 can enter a heat exchanger 474, wherein the stream can be heated and at least partially vaporized via indirect heat exchange with an external fluid (e.g., steam or other warmed hear transfer media). The vaporized portion of the bottoms product in conduit 442 can be reintroduced into third distillation column 458, wherein the stream can provide at least a portion of the overall column heat duty. The remaining liquid portion can be withdrawn from heat exchanger 474 via conduit 444 and can thereafter enter heat exchanger 472, wherein the stream can be cooled via indirect heat exchange with the feed stream to third distillation column 458 in conduit 424, as previously discussed. The resulting cooled bottoms product stream in conduit 446 can then be routed downstream for further use, processing, and/or storage.

According to one embodiment presented in FIG. 2*d*, an overhead product stream can be withdrawn from an upper outlet of third distillation column 458 via conduit 427. At least a portion of the predominantly vapor stream can subsequently enter heat exchanger 452, wherein the stream can be cooled and at least partially liquefied via indirect heat exchange means 468. As shown in FIG. 2*d*, the resulting cooled, two-phase stream can then be separated in vapor-liquid separator 456 and at least a portion of the liquid phase can be introduced into a reflux inlet of heavies removal column 450 as a second reflux stream via conduit 436, as previously discussed with respect to FIG. 2*b*. The vapor stream exiting separator 456 can subsequently be routed to the plant fuel gas system via conduit 432.

Figure 3A:
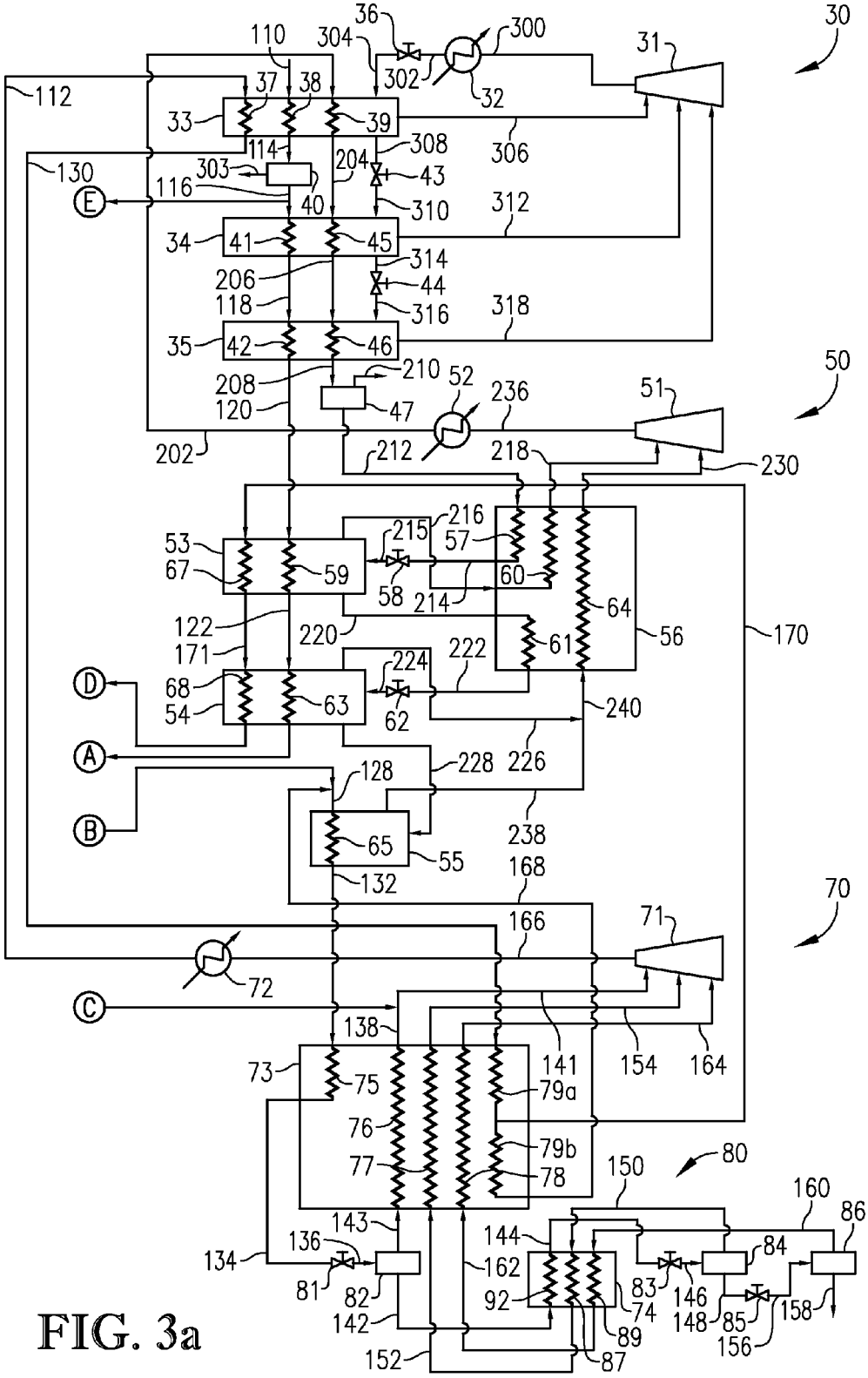
FIG. 3*a* is a schematic diagram a cascade-type LNG facility configured in accordance with a further embodiment of present invention with certain portions of the LNG facility connecting to lines A, B, C, and D being illustrated in FIG. 3*b*.
Figure 3B:
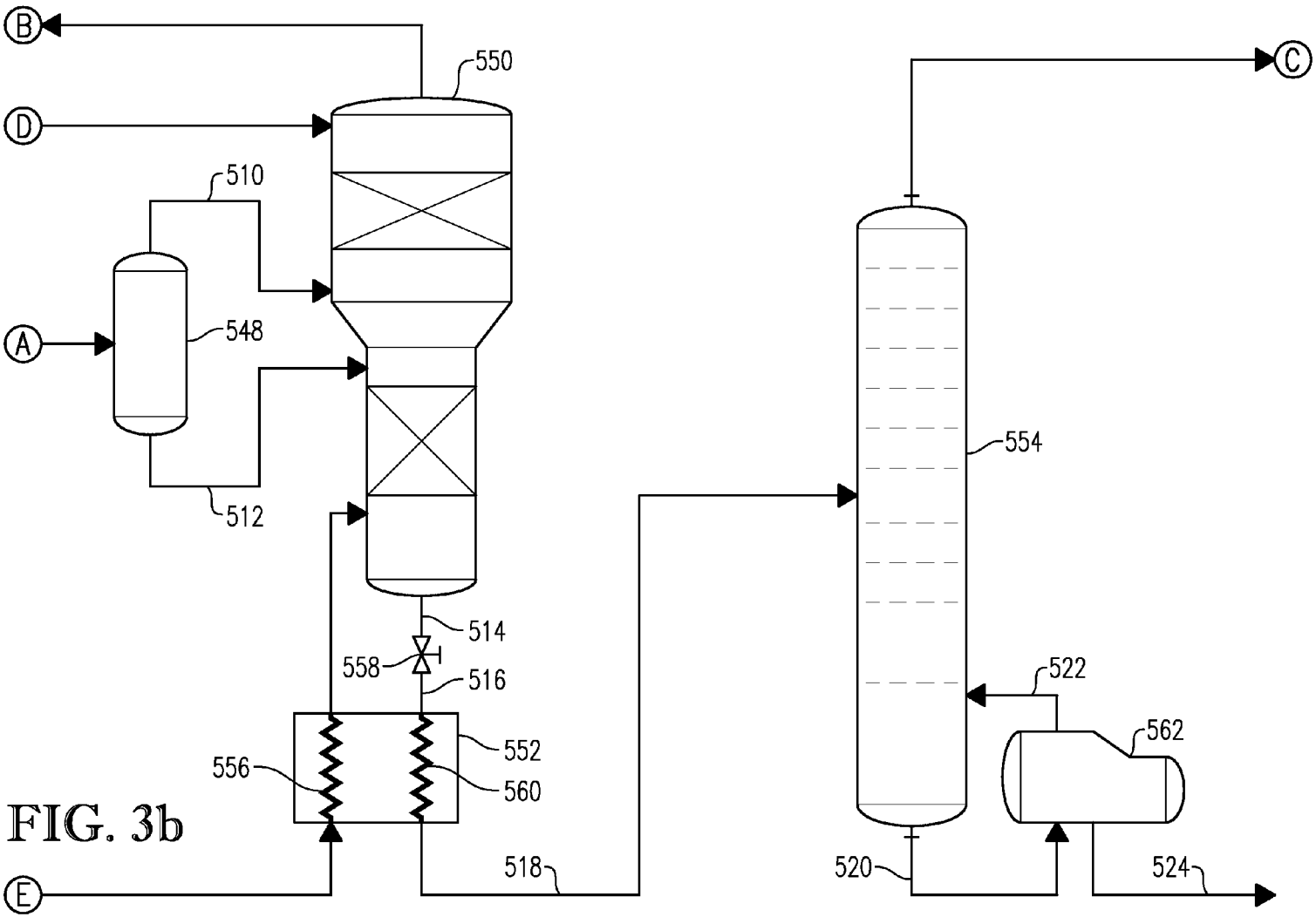
FIG. 3*b* is a schematic diagram illustrating one embodiment of a heavies removal zone integrated into the LNG facility of FIG. 3*a* via lines A, B, C, and D.

Referring now to FIG. 3*a*, a cascade-type LNG facility in accordance with another embodiment of the present invention is illustrated. FIG. 3*b* illustrates another embodiment of a heavies removal zone that is integrated into the LNG facility of FIG. 3*a* via lines A, B, C, D, and E. The main components of the LNG facility represented by FIG. 3*a* are the same as those listed previously with respect to FIG. 2*a*. Operationally, the LNG facility illustrated in FIG. 3*a* will now be described as it differs from the LNG facility previously described with respect to FIG. 2*a*. As shown in FIG. 3*a*, at least a portion of the stream exiting vapor-liquid separator 40 via conduit 116 can be withdrawn via conduit E. The stream in conduit E can subsequently be routed to the heavies removal zone, wherein the stream can be employed as a stripping gas in the heavies removal column. One embodiment of a heavies removal zone that utilizes a stripping gas stream in conduit E will be discussed with respect to FIG. 3*b*.

Referring now to FIG. 3*b*, a heavies removal zone in accordance with another embodiment of the present invention is shown. The heavies removal zone depicted in FIG. 3*b* can be integrated into the LNG facility illustrated in FIG. 3*a* via lines A, B, C, D, and E. The main components of the heavies removal zone illustrated in FIG. 3*b* include a vapor-liquid separator 548, a first distillation column 550, a heat exchanger 552, and a second distillation column 554.

Turning now to the operation of the heavies removal zone illustrated in FIG. 3*b*, the predominantly methane stream exiting intermediate-stage ethylene chiller 54 shown in FIG. 3*a* enters the heavies removal zone depicted in FIG. 3*b* via conduit A. As shown in FIG. 3*b*, the stream can then enter a fluid inlet of vapor-liquid separator 548, wherein the vapor and liquid portions can be separated. The vapor portion can be withdrawn from an upper outlet of vapor-liquid separator 548 via conduit 510 and can then be introduced into a reflux inlet located in the upper portion of first distillation column 550. In one embodiment, the liquid portion withdrawn from separator 448 via conduit 512 can be introduced as a reflux stream into a reflux inlet located in the lower portion of heavies removal column 550. As illustrated in FIG. 3*b*, a subcooled, predominantly liquid stream exiting intermediate-stage ethylene chiller 54 in FIG. 3*a* can be introduced via conduit D into the upper portion of heavies removal column 550. As shown in FIG. 3*b*, a predominantly vapor, methane rich overhead stream can be withdrawn from an upper outlet heavies removal column 550 via conduit B and can then be routed to the methane refrigeration cycle of the LNG facility illustrated in FIG. 3*a* prior to combining with the methane refrigerant stream in conduit 168, as previously discussed.

As discussed previously, a predominantly methane stream exiting the outlet of separator 40 in FIG. 3*a* can be routed via conduit E to the heavies removal zone depicted in FIG. 3*b*. As shown in FIG. 3*b*, the stream in conduit E can enter heat exchanger 552, wherein the stream can be cooled via indirect heat exchange means 556. The resulting cooled stream can be introduced into a stripping gas inlet located in the lower portion of heavies removal column 550, wherein the stream can be employed as a stripping gas to enhance the separation efficiency of heavies removal column 550.

As shown in FIG. 3*b*, a predominantly liquid bottoms product can be withdrawn from a lower outlet of heavies removal column 550 via conduit 514. Thereafter, the stream can be passed through a pressure reduction means, illustrated herein as expander 558, wherein the pressure of the stream can be reduced to thereby vaporize or flash a portion thereof. The resulting two phase stream in conduit 516 can then enter heat exchanger 552, wherein the stream can be warmed via an indirect heat exchange means 560 prior to entering a fluid inlet of second distillation column 554 via conduit 518.

As illustrated in FIG. 3*b*, a predominantly vapor overhead product stream can be withdrawn from an upper outlet of second distillation column 554 via conduit C and can thereafter be routed to the methane refrigeration cycle of the LNG facility illustrated in FIG. 3*a*, as previously discussed. A predominantly liquid bottoms product stream can be withdrawn from a lower outlet of second distillation column 554 via conduit 520, whereafter the stream can be at least partially vaporized in heat exchanger 562 via indirect heat exchange with an external fluid (e.g., steam or other heated heat transfer medium). The vaporized portion of the stream exiting heat exchanger 562 can subsequently be returned to second distillation column 554 to provide at least a portion of the overall heat duty. The remaining liquid portion exits heat exchanger 562 via conduit 524, whereafter the stream can be routed downstream for further processing, use, and/or storage.

In one embodiment of the present invention, the LNG production systems illustrated in FIGS. 1 through 3*b* are simulated on a computer using conventional process simulation software in order to produce simulation results. In one embodiment, the simulation results can be in the form of a computer print out. In another embodiment, the simulation results can be displayed on a screen, monitor, or other viewing device. In yet another embodiment, the simulation results may be electronic signals directly communicated into the LNG system for direct control and/or optimization of the system.

The simulation results can then be used to manipulate the LNG system. In one embodiment, the simulation results can be used to design a new LNG facility and/or revamp or expand an existing LNG facility. In another embodiment, the simulation results can be used to optimize the LNG facility according to one or more operating parameters. In a further embodiment, the computer simulation can directly control the operation of the LNG facility by, for example, manipulating control valve output. Examples of suitable software for producing the simulation results include HYSYS™ or Aspen Plus® from Aspen Technology, Inc., and PRO/II® from Simulation Sciences Inc.

Numerical Ranges

The present description uses numerical ranges to quantify certain parameters relating to the invention. It should be understood that when numerical ranges are provided, such ranges are to be construed as providing literal support for claim limitations that only recite the lower value of the range as ell as claims limitation that only recite the upper value of the range. For example, a disclosed numerical range of 10 to 100 provides literal support for a claim reciting "greater than 10" (with no upper bounds) and a claim reciting, "less than 100" (with no lower bounds).

Definitions

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "cascade-type refrigeration process" refers to a refrigeration process that employs a plurality of refrigeration cycles, each employing a different pure component refrigerant to successively cool natural gas.

As used herein, the term "closed-loop refrigeration cycle" refers to a refrigeration cycle wherein substantially no refrigerant enters or exits the cycle during normal operation.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided below.

As used herein, the terms "economizer" or "economizing heat exchanger" refer to a configuration utilizing a plurality of heat exchangers employing indirect heat exchange means to efficiently transfer heat between process streams.

As used herein, the terms "having," "has," and "have" have the same open-ended meaning as "comprising," "comprises," and "comprise." provided above.

As used herein, the terms "heavy hydrocarbon" and "heavies" refer to any hydrocarbon component having a molecular weight greater than methane.

As used herein, the terms "including," "includes," and "include" have the same open-ended meaning as "comprising," "comprises," and "comprise," provided above.

As used herein, the term "mid-range standard boiling, point" refers to the temperature at which half of the weight of a mixture of physical components has been vaporized (i.e. boiled off) at standard pressure.

As used herein, the term "mixed refrigerant" refers to a refrigerant containing a plurality of different components, where no single component makes up more than 75 mole percent of the refrigerant.

As used herein, the term "natural gas" means a stream containing at least 85 mole percent methane, with the balance being ethane, higher hydrocarbons, nitrogen, carbon dioxide, and/or a minor amount of other contaminants such as mercury, hydrogen sulfide, and mercaptan.

As used herein, the terms "natural gas liquids" or "NGL" refer to mixtures of hydrocarbons whose components are, for example, typically heavier than ethane. Some examples of hydrocarbon components of NGL streams include propane, butane, and pentane isomers, benzene, toluene, and other aromatic compounds.

As used herein, the term "open-loop refrigeration cycle" refers to a refrigeration cycle wherein at least a portion of the refrigerant employed during normal operation originates from an external source.

As used herein, the terms "predominantly," "primarily," "principally," and "in major portion," when used to describe the presence of a particular component of a fluid stream, means that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, the term "pure component refrigerant" means a refrigerant that is not a mixed refrigerant.

As used herein, the terms "upstream" and "downstream" refer to the relative positions of various components of a natural gas liquefaction facility along the main flow path of natural gas through the plant.

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method comprising:

cooling a predominantly methane stream in a refrigeration cycle to form a cooled predominantly methane stream;

separating the cooled predominantly methane stream in a first distillation column to produce a first bottoms stream, a first overhead stream, and a predominately liquid bottoms stream, wherein the first bottoms stream, the first overhead stream and the predominantly liquid bottoms stream are separate streams upon expulsion from the first distillation column, wherein the first bottoms stream and the predominantly liquid bottoms stream are each routed from the first distillation column to a heat exchanger;

introducing a first reflux stream comprising at least about 85 mole percent methane into the first distillation column; and heating the predominantly liquid bottoms stream in the heat exchanger to provide an at least partially vaporized stream, which is introduced into the first distillation column;

heating the first bottoms stream in the heat exchanger before being introduced into a second distillation column;

separating the first bottoms stream in the second distillation column to withdrawal a natural gas liquids stream and produce a second overhead stream;

dividing the second overhead stream into first and second portions;

cooling the second portion of the second overhead stream in the heat exchanger via indirect heat exchange with the first bottoms stream and the predominantly liquid bottoms stream to produce a two-phase stream;

separating vapor and liquids of the two-phase stream in a separator;

introducing the liquids from the separator as a second reflux stream into the first distillation column at a lower elevation than the first reflux stream; wherein the second reflux stream is introduced into the first distillation column at a lower elevation than the cooled predominantly methane stream;

combining the vapor from the separator with the first portion of the second overhead stream to provide a heavies removal zone exit stream; and combining the heavies removal zone exit stream with a methane-rich vapor stream to provide a combined methane compressor inlet stream, which is routed to a methane compressor.

2. The method of claim 1, wherein the temperature of the cooled predominantly methane stream when introduced into the first distillation column is less than about −50° F.

3. The method of claim 1, wherein the first bottoms stream is not fractionated between the first distillation column and the second distillation column.

4. The method of claim 1, further comprising, cooling at least a portion of the first overhead stream in a methane refrigeration cycle to produce a cooled first overhead stream, wherein the first reflux stream comprises at least a portion of the cooled first overhead stream.

5. The method of claim 1, wherein the average molecular weight of the second reflux stream is at least about 10 percent greater than the average molecular weight of the first reflux stream.

6. The method of claim 1, wherein the first reflux stream has an average molecular weight less than about 24 grams per mole.

7. The method of claim 1, wherein the second reflux stream has an average molecular weight less than about 52 grams per mole.

8. The method of claim 1, wherein the second reflux stream comprises at least about 15 mole percent of ethane and/or ethylene and less than about 60 mole percent of propane and heavier components.

9. The method of claim 1, wherein the overhead operating temperature of the first distillation column is in the range of from about −200° F. to about −75° F. and the overhead operating pressure of the first distillation column is in the range of from about 20 barg to about 70 barg.

10. The method of claim 1, wherein the refrigeration cycle is part of a cascade LNG process employing sequential propane, ethylene, and methane refrigeration cycles.

11. The method of claim 1, further comprising vaporizing liquefied natural gas product produced from the first overhead stream and heavies removal zone exit stream.

* * * * *